US008616912B1

(12) United States Patent
Vendura

(10) Patent No.: US 8,616,912 B1
(45) Date of Patent: Dec. 31, 2013

(54) ELECTRICAL OUTLET AND A CORD RELEASABLY MOUNTED TO A LADDER

(76) Inventor: Keith Vendura, Daytona Beach, FL (US)

( * ) Notice: Subject to any disclaimer, the term of this patent is extended or adjusted under 35 U.S.C. 154(b) by 25 days.

(21) Appl. No.: 13/443,582

(22) Filed: Apr. 10, 2012

(51) Int. Cl.
*H01R 13/62* (2006.01)

(52) U.S. Cl.
USPC ..... 439/368

(58) Field of Classification Search
USPC ..... 439/367–373; 174/51, 135; 182/129
See application file for complete search history.

(56) References Cited

U.S. PATENT DOCUMENTS

| | | | | |
|---|---|---|---|---|
| 3,999,628 | A | 12/1976 | Parson | |
| 4,494,627 | A | 1/1985 | Arent | |
| 4,982,885 | A * | 1/1991 | Severson et al. | 224/675 |
| 5,044,976 | A * | 9/1991 | Thompson | 439/368 |
| 5,419,409 | A * | 5/1995 | Corulla | 182/129 |
| 5,584,357 | A | 12/1996 | Gugel et al. | |
| 6,004,138 | A | 12/1999 | Harbertson | |
| 6,217,366 | B1 * | 4/2001 | Weisstock | 439/369 |
| 6,369,323 | B1 * | 4/2002 | Wright | 174/51 |
| 6,502,664 | B1 * | 1/2003 | Peaker, Sr. | 182/129 |
| D472,520 | S | 4/2003 | Genicevitch | |
| 7,174,994 | B1 * | 2/2007 | Coffield et al. | 182/129 |
| 7,264,084 | B1 * | 9/2007 | Switzer | 182/129 |
| 7,857,654 | B2 * | 12/2010 | West et al. | 439/373 |
| 7,887,360 | B2 * | 2/2011 | Andrade | 439/369 |
| 8,134,074 | B2 * | 3/2012 | Ong et al. | 174/135 |

* cited by examiner

*Primary Examiner* — Chandrika Prasad

(57) ABSTRACT

An electrical outlet assembly includes a housing that has a back panel and a perimeter wall coupled to and extending from a perimeter edge of the back panel. The perimeter wall has a distal edge relative to the back panel. The distal edge of the perimeter wall defines an outlet opening into the interior of the housing. An electrical outlet is positioned within the interior of the housing. An electrical cord is electrically coupled to the electrical outlet. The electrical cord extends from the housing so that a medial section of the electrical cord is positioned outside of the interior of the housing. A fastener is coupled to the housing. The fastener couples the housing to the ladder. A plurality of straps is coupled to the medial section of the electrical cord. Each of the straps is configured for coupling the electrical cord to the ladder.

11 Claims, 4 Drawing Sheets

ELECTRICAL OUTLET AND A CORD RELEASABLY MOUNTED TO A LADDER

BACKGROUND OF THE DISCLOSURE

Field of the Disclosure

The disclosure relates to electrical outlet devices and more particularly pertains to a new electrical outlet device for mounting on a ladder.

SUMMARY OF THE DISCLOSURE

An embodiment of the disclosure meets the needs presented above by generally comprising a housing that has a back panel and a perimeter wall that is coupled to and extends from a perimeter edge of the back panel to define an interior of the housing. The perimeter wall has a distal edge relative to the back panel. The distal edge of the perimeter wall defines an outlet opening into the interior of the housing. An electrical outlet is coupled to the housing. The electrical outlet is positioned within the interior of the housing. An electrical cord has a first end that is electrically coupled to the electrical outlet. The electrical cord extends from the housing so that a medial section of the electrical cord is positioned outside of the interior of the housing. A fastener is coupled to the housing. The fastener couples the housing to the ladder. A plurality of straps is coupled to the medial section of the electrical cord. Each of the straps is configured for coupling the electrical cord to the ladder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
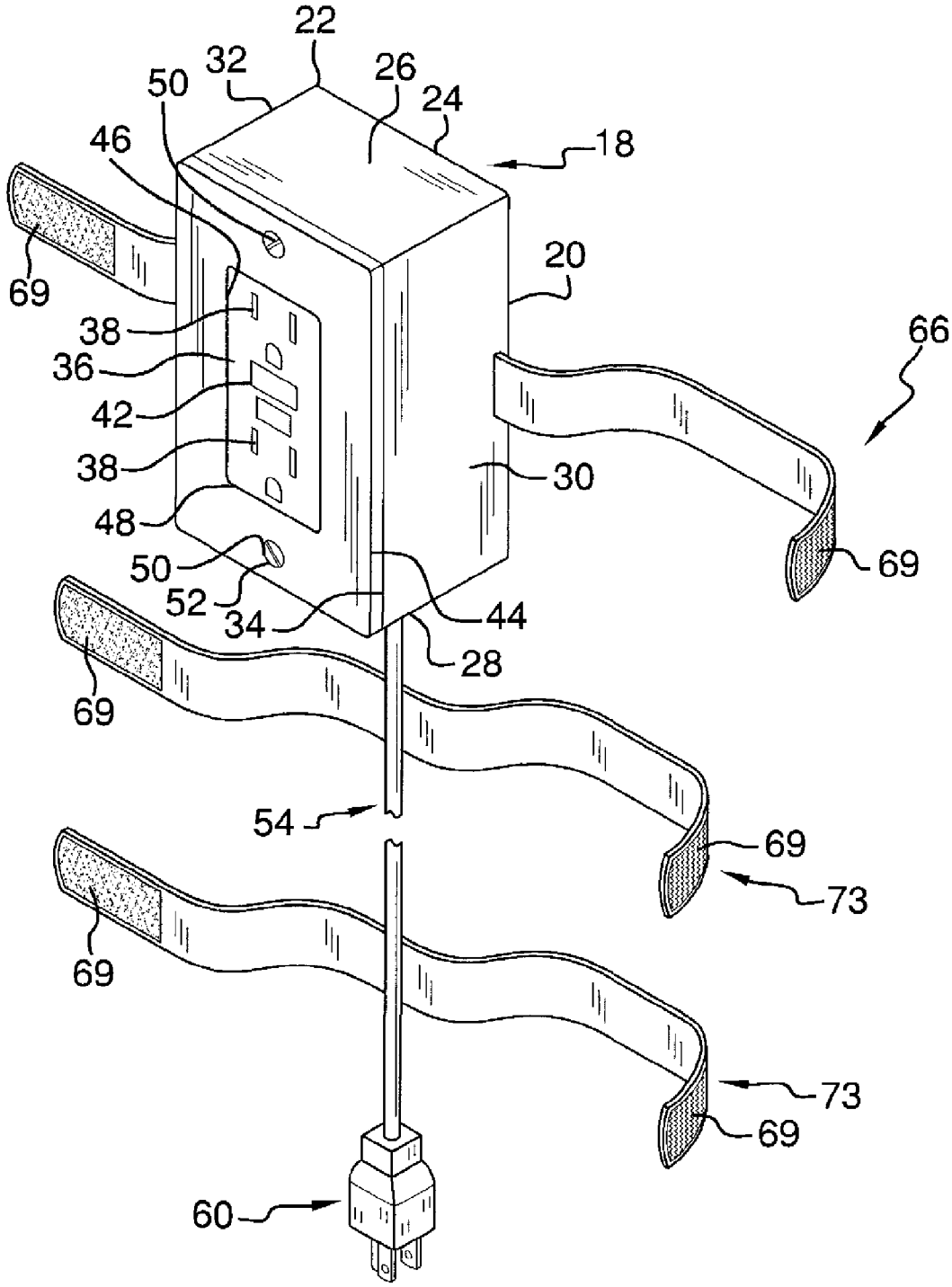
FIG. 1 is a perspective view of a electrical outlet assembly according to an embodiment of the disclosure.
Figure 2:
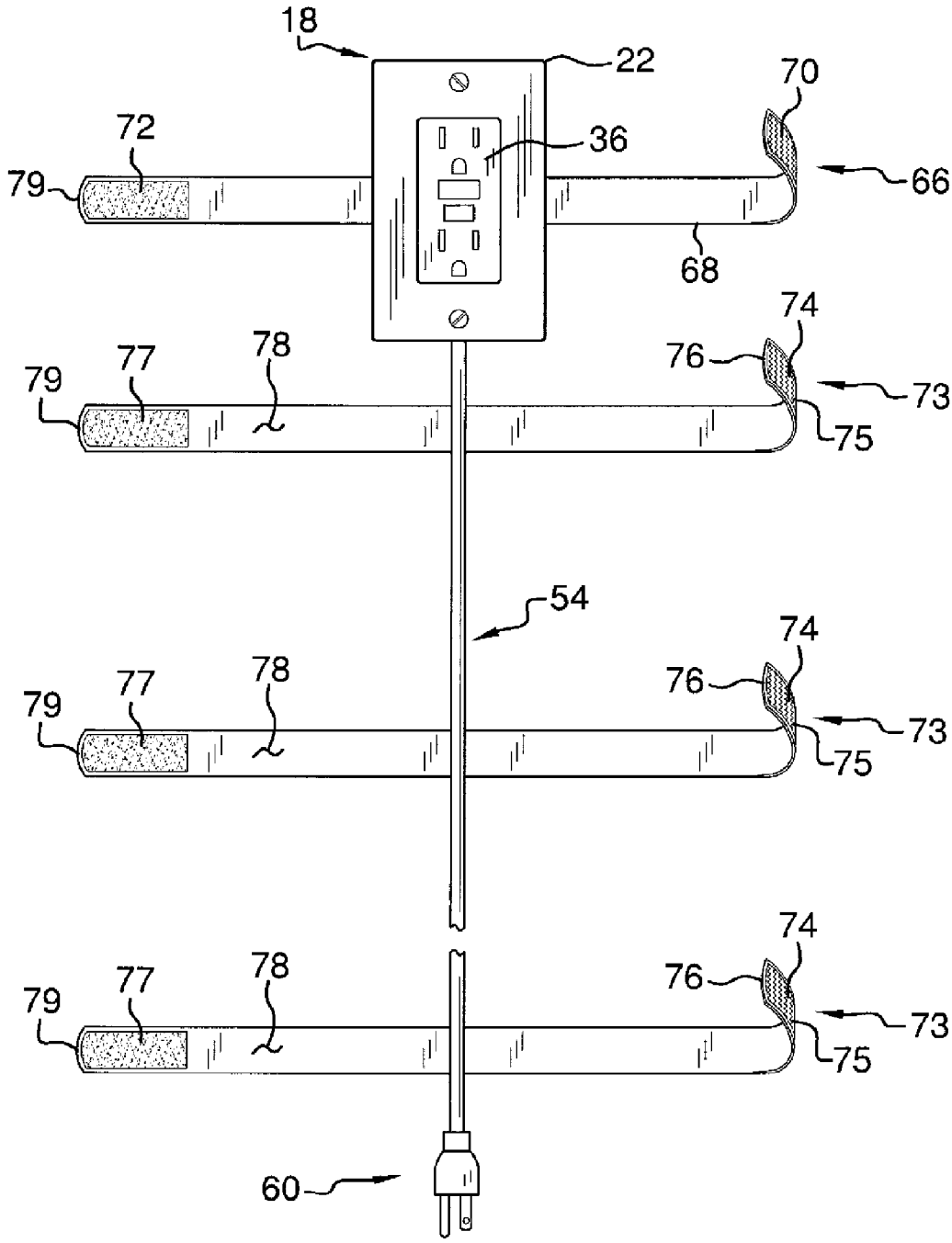
FIG. 2 is a front view of an embodiment of the disclosure.
Figure 3:
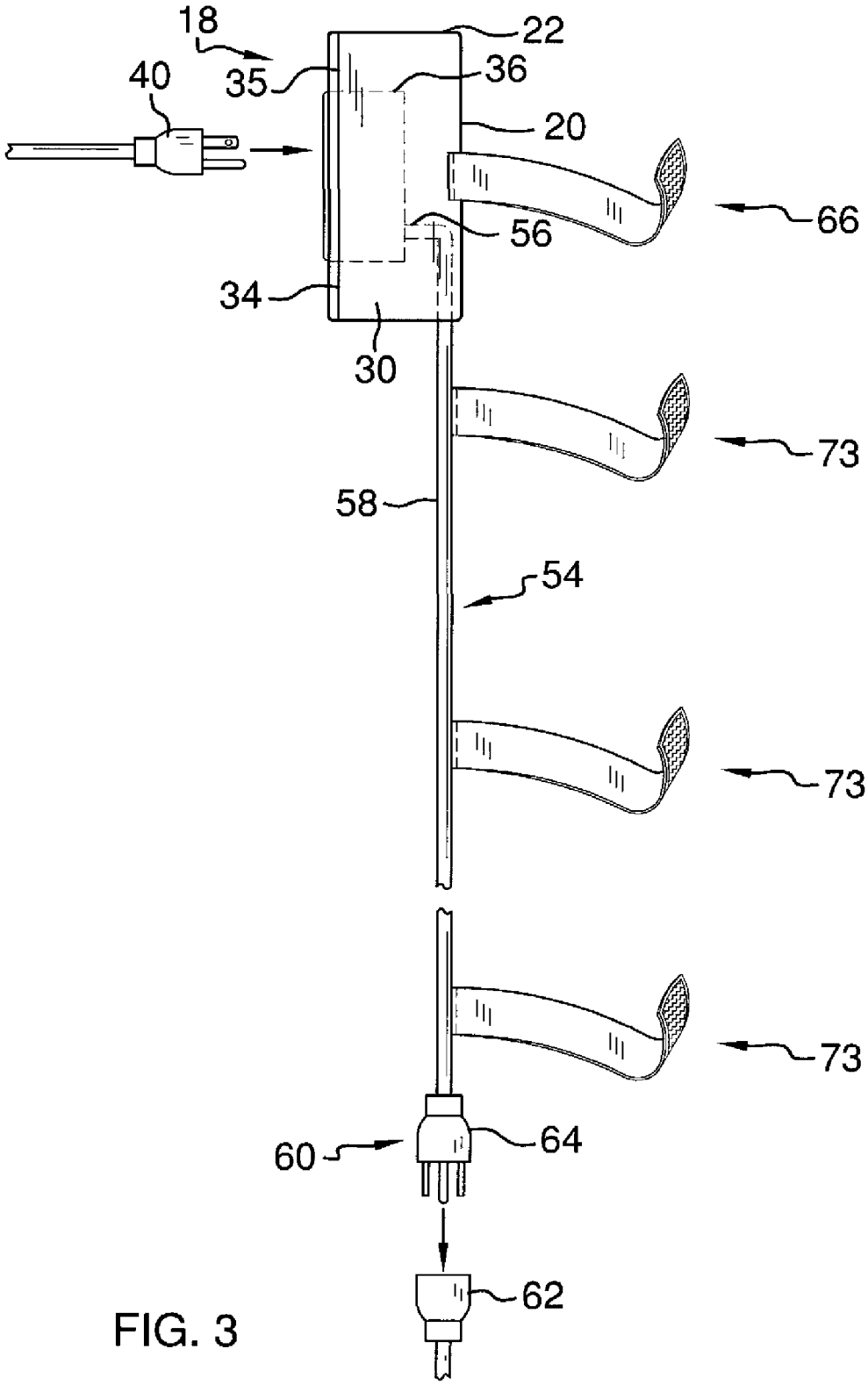
FIG. 3 is a right side view of an embodiment of the disclosure.
Figure 4:
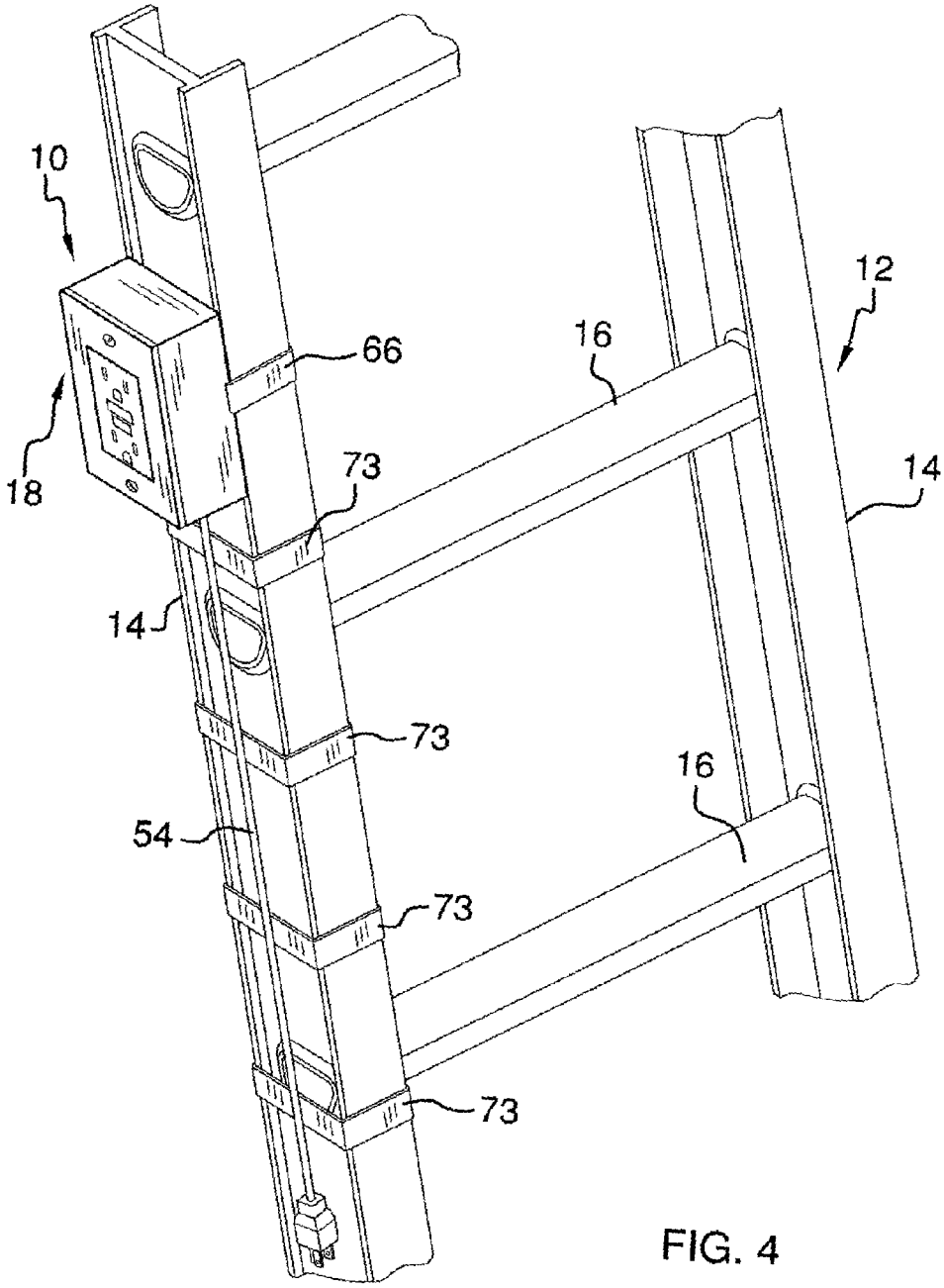
FIG. 4 is an in-use view of an embodiment of the disclosure.

With reference now to the drawings, and in particular to FIGS. 1 through 4 thereof, a new electrical outlet device embodying the principles and concepts of an embodiment of the disclosure and generally designated by the reference numeral 10 will be described.

As best illustrated in FIGS. 1 through 4, the electrical outlet assembly 10 generally comprises a ladder 12 having a pair of side rails 14 and a plurality of rungs 16 coupled to and extending between the side rails 14. The ladder 12 may be of any conventional design. A housing 18 has a back panel 20 and a perimeter wall 22 that is coupled to and extends outwardly from a perimeter edge 24 of the back panel 20 to define an interior of the housing 18. The perimeter wall 22 includes a top section 26, a bottom section 28, a first lateral section 30, a second lateral section 32 and a front edge 34. The front edge defines an outlet opening 35. The housing 18 may be comprised of a non-electrically conductive material.

An electrical outlet 36 is coupled to the housing 18 and is positioned in the interior of the housing 18. The electrical outlet 36 has a pair of female receptacles 38. Each of the female receptacles 38 is configured to removably receive a male plug 40 of an electrical power tool to supply an electrical current to the power tool. The electrical outlet 36 may be of any conventional design and may include a GFI protection circuit 42.

A cover plate 44 is coupled to the housing 18. The cover plate 44 is positioned over the outlet opening. The cover plate 44 has an interior edge 46 defining an outlet aperture 48. The outlet aperture 48 provides access to the female receptacles 38 of the electrical outlet 36. The cover plate 44 has a pair of retainer apertures 50 extending therethrough. A pair of retainers 52 may be provided. Each of the retainers 52 extends through the retainer apertures 50 to engage the housing 18 to retain the cover plate 44 on the housing 18.

An electrical cord 54 has a first end 56 that is electrically coupled to the electrical outlet 36. The electrical cord 54 extends from the housing 18 so that a medial section 58 of the electrical cord 54 is positioned outside of the interior of the housing 18. The electrical cord 54 has a second end 60 configured for coupling to a power source 62. The second end 60 of the electrical cord 54 is a male electrical plug 64. The second end 60 is configured to uncouple from the power source 62 if the power source 62 is pulled on or moved to prevent the ladder 12 from tipping over. The electrical cord 54 may be of any conventional design.

A fastener is 66 coupled to the housing 18. The fastener 66 is configured for coupling the housing 18 to the ladder 12. The fastener 66 is a band 68 and a first portion of a hook and loop fastener 70 is coupled to the band. A second portion of a hook and loop fastener 72 is coupled to the band 68. The second portion of hook and loop fastener 72 is complimentary to the first portion of hook and loop fastener 70. The band 68 is configured for securing the housing 18 to one of the side rails 14 of the ladder 12 so the electrical cord 54 hangs downwardly from the housing 18.

A plurality of straps 73 is coupled to the medial section 58 of the electrical cord 54. Each of the straps 73 is configured for coupling the electrical cord 54 to one of the side rails 14 of the ladder 12. A plurality of first mating members 74 is each coupled to an associated one of the straps 73. Each the first mating member 74 is positioned on a first face 75 of the associated strap 73 adjacent to a first end 76 of the associated strap 73. Each of the straps 73 may be comprised of a flexible material.

A plurality of second mating members 77 is complimentary to the first mating members 74. Each second mating member 77 is coupled to an associated one of the straps 73 with one of the first mating members 74. Each strap 73 is configured for securing the electrical cord 54 to a side rail 14 of the ladder 12. Each of the second mating members 77 is positioned on a second face 78 of the associated strap 73 adjacent to a second end 79 of the associated strap 73. The first mating members 74 and the second mating members 77 are portions of a hook and loop fastener 69.

In use, the housing 18 may be fastened to the side rail 14 of the ladder 12 at a selected point. A power source 62 may be connected to the second end 60 rather than being tied to the ladder 12. In the event of accidental movement or pulling of the power source 62, the power source 62 may uncouple from the second end 60 to prevent the ladder 12 from tipping over.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A ladder mountable electrical outlet assembly configured to be mounted on a ladder, said assembly comprising;

a housing having a back panel and a perimeter wall coupled to and extending from a perimeter edge of said back panel defining an interior of said housing, said perimeter wall having a distal edge relative to said back panel, said distal edge of said perimeter wall defining an outlet opening into said interior of said housing;

an electrical outlet coupled to said housing, said electrical outlet being positioned within said interior of said housing;

an electrical cord having a first end electrically coupled to said electrical outlet, said electrical cord extending from said housing whereby a medial section of said electrical cord is positioned outside of said interior of said housing, said electrical cord having a second end configured for coupling to a power source;

a fastener coupled to said housing, said fastener being configured for releasably coupling said housing to the ladder; and a plurality of straps, each of said straps being coupled to said medial section of said electrical cord, each of said straps being configured for releasably coupling said electrical cord to the ladder, said straps being evenly distributed between said first and second ends of said electrical cord.

2. The assembly of claim 1, further including said electrical outlet having a pair of female receptacles.

3. The assembly of claim 1, further comprising:

a plurality of first mating members, each first mating member being coupled to an associated one of said straps; and a plurality of second mating members complimentary to said first mating members, each second mating member being coupled to an associated one of said straps with one of said first mating members whereby each strap is configured for securing said electrical cord to a side rail of the ladder.

4. The assembly of claim 3, further including said first mating members and said second mating members being portions of hook and loop fastener.

5. The assembly of claim 3, further including each said first mating member being positioned on a first face of said associated strap adjacent to a first end of said associated strap.

6. The assembly of claim 5, further including each said second mating member being positioned on a second face of said associated strap adjacent to a second end of said associated strap.

7. The assembly of claim 1, further including said second end of said electrical cord being a male electrical plug.

8. The assembly of claim 1, further including a cover plate coupled to said housing, said cover plate being positioned over said outlet opening.

9. The assembly of claim 8, further including said cover plate having an interior edge defining an outlet aperture, said outlet aperture providing access to said electrical outlet therethrough.

10. The assembly of claim 1, further comprising:

said fastener being a band;

a first portion of hook and loop fastener coupled to said band; and a second portion of hook and loop fastener coupled to said band, said second portion of hook and loop fastener being complimentary to said first portion of hook and loop fastener whereby said band is configured for securing said housing to the ladder.

11. A ladder mountable electrical outlet assembly configured to be mounted on a ladder, said assembly comprising;

a housing having a back panel and a perimeter wall being coupled to and extending outwardly from a perimeter edge of said back panel defining an interior of said housing, said perimeter wall including a top section, a bottom section, a first lateral section, a second lateral section, and a front edge;

an electrical outlet, said electrical outlet being coupled to said housing and positioned in the interior of said housing, said electrical outlet having a pair of female receptacles, each of said female receptacles being configured to removably receive a male plug of an electrical power tool to supply an electrical current to said power tool;

a cover plate, said cover plate coupled to said housing, said cover plate being positioned over said outlet opening, said cover plate having an interior edge defining an outlet aperture, said outlet aperture providing access to said female receptacles of said electrical outlet;

an electrical cord having a first end electrically coupled to said electrical outlet, said electrical cord extending from said housing whereby a medial section of said electrical cord is positioned outside of said interior of said housing, said electrical cord having a second end configured for coupling to a power source, said second end of said electrical cord being a male electrical plug;

a fastener coupled to said housing, said fastener being configured for releasably coupling said housing to the ladder, said fastener being a band, a first portion of hook and loop fastener being coupled to said band, a second portion of hook and loop fastener being coupled to said band, said second portion of hook and loop fastener being complimentary to said first portion of hook and loop fastener whereby said band is configured for securing said housing to the ladder;

a plurality of straps, each of said straps being coupled to said medial section of said electrical cord, each of said straps being configured for releasably coupling said electrical cord to the ladder, said straps being evenly distributed between said first and second ends of said electrical cord;

a plurality of first mating members, each first mating member being coupled to an associated one of said straps, each said first mating member being positioned on a first face of said associated strap adjacent a first end of said associated strap; and a plurality of second mating members complimentary to said first mating members, each second mating member being coupled to an associated one of said straps with one of said first mating members whereby each strap is configured for securing said electrical cord to a side rail of the ladder, each said second mating member being positioned on a second face of said associated strap adjacent to a second end of said associated strap, said first mating members and said second mating members being portions of hook and loop fastener.

* * * * *